United States Patent [19]

Banyai et al.

[11] Patent Number: 4,948,430

[45] Date of Patent: Aug. 14, 1990

[54] ORE PELLETS CONTAINING CARBOXYMETHYLHYDROXYETHYLCELLULOSE AND SODIUM CARBONATE

[75] Inventors: Bruce E. Banyai; Denis E. LaSota; Dennis L. Strunk, all of Wilmington, Del.

[73] Assignee: Aqualon Company, Wilmington, Del.

[21] Appl. No.: 366,597

[22] Filed: Jun. 15, 1989

[51] Int. Cl.[5] ..... C08L 1/08; C08L 126

[52] U.S. Cl. ..... 75/321; 106/194

[58] Field of Search ..... 106/194; 75/3

[56] References Cited

U.S. PATENT DOCUMENTS

| | | | |
|---|---|---|---|
| 3,959,003 | 5/1976 | Ostroot | 106/194 |
| 4,184,888 | 1/1980 | Zoumut | 106/194 |
| 4,288,245 | 9/1981 | Roorda et al. | 106/304 |
| 4,378,049 | 3/1983 | Hsu et al. | 166/295 |
| 4,597,797 | 8/1986 | Roorda et al. | 106/194 |
| 4,707,189 | 11/1987 | Nickol | 106/197.2 |

FOREIGN PATENT DOCUMENTS

| | | |
|---|---|---|
| 4654485 | 8/1985 | Australia . |

*Primary Examiner*—Paul Lieberman
*Assistant Examiner*—Helene Klemanski
*Attorney, Agent, or Firm*—James K. Luchs

[57] ABSTRACT

A binder for agglomerating an ore in the presence of water, contains 10% to 90% of a water-soluble sodium carboxymethylhydroxyethylcellulose and 10% to 90% of sodium carbonate. A process comprises mixing a binder composition containing cellulose and sodium carbonate, water, and the ore, agglomerating the mixture into wet balls, drying the wet balls, and heating the resultant dry balls at a temperature of at least about 1204° C. A preferred ore is taconite.

4 Claims, No Drawings

ORE PELLETS CONTAINING CARBOXYMETHYLHYDROXYETHYLCELLULOSE AND SODIUM CARBONATE

FIELD OF THE INVENTION

This invention is directed to a binder for agglomerating concentrated ore, in particular, iron containing ore also containing a water soluble cellulose derivative, to a process for agglomerating concentrated ore using the binder, and to the agglomerated product of the process.

BACKGROUND OF THE INVENTION

Raw or pig iron, used for making steel, is generally prepared by sintering a composition consisting of concentrated iron ore, consisting of iron oxide and residual silica (e.g., quartz), flux (e.g., limestone or dolomite), and coke. The flux is added to purge impurities, i.e., neutralize the silica. Slag, which results from this neutralization process, separates from the molten iron in the blast furnace. There is presently a desire to increase the efficiency of blast furnaces by reducing the volume of slag. Correspondingly, it is desired to reduce the cost of steel by reducing the amount of slag produced when processing pig iron, i.e., by reducing the amount of silica entering the blast furnace.

The concentrated iron ore used in steel making is obtained from mined ores comprised of "host rock", i.e., rock comprised of silica and iron oxide. In order to reduce shipping and handling costs iron oxide is normally separated from the host rock at or near the mine by, for example, magnetic and/or froth flotation processes. Many ores, in particular the taconite ore found in North America, require ultra fine grinding prior to carrying out such separation processes. Because of this grinding the concentrated ore is a fine powder which cannot be easily handled, shipped, or charged into a blast furnace.

Therefore, the concentrated ore is agglomerated into porous particles or pellets generally having an average diameter of approximately 3/8 inch by rotating the concentrated ore powder in a drum or disc with a binder and water to form balls, followed by firing the balls in an indurating furnace. The resulting particles or pellets are hard and are easily handled, shipped, and charged to a blast furnace.

Until recently, bentonite clay was the preferred binder for agglomerating concentrated ore particles; it provides moisture and growth control, and balls prepared with bentonite have very good wet and dry strength. But one problem with bentonite is that it contains a large amount of silica, which must be neutralized in the blast furnace, by adding additional amounts of flux. Accordingly, efforts have been made to replace bentonite with a product that has the beneficial attributes of bentonite without contributing silica. So called "organic based binders", such as alkali metal salts of carboxymethylcellulose, have been considered as replacements for bentonite; since they do not contain silica they do not require the use of additional flux, they burn off during sintering, and they increase the ratio of surface area to mass of the concentrated ore-containing pellet.

Also, the reduction of the pellets produced using organic binders is much more efficient because of their larger surface area. The rate of reduction of iron oxide to the metallic state in the blast furnace by reducing gases, such as carbon monoxide, is directly proportional to that surface to-mass ratio, in other words, to the pore volume. During sintering, bentonite fuses to a glass-like ceramic material that seals pores, while the pore volume of pellets produced using organic binders increases as the organic binder burns off.

Australian Patent Application No. AU-A 46544/85 describes a method for agglomerating a particulate material such as mineral ore concentrate comprising mixing the particulate material with a binding amount of water-soluble, ore binding polymer and clay. The polymer is hydroxyethyl cellulose in combination with sodium carbonate. U.S. Pat. Nos. 4,288,245 and 4,597,797 suggest that the binding Performance of alkali metal salts of carboxymethyl cellulose can be improved by inclusion of at least 2% of a salt of an alkali metal and a weak acid having a pK value higher than 3 and a molecular weight lower than 500, such as salts of acetic acid, benzoic acid, lactic acid, propionic acid, tartaric acid, succinic acid, citric acid, nitrous acid, boric acid and carbonic acid. One such binder is marketed under the name Peridur$^R$ and is believed to contain the sodium salt of carboxymethylcellulose, sodium carbonate, and by-products from the formation of the carboxymethylcellulose, including sodium chloride and sodium glycolate.

The inventors have studied binder compositions of sodium carboxymethylhydroxyethylcellulose and sodium carbonate and discovered superior dry-strength performance versus binders known in the prior art.

SUMMARY OF THE INVENTION

A binder for agglomerating a metal containing ore material in the presence of water comprising about 90% to about 10% sodium carboxymethylhydroxyethylcellulose and about 10% to about 90% of an alkali metal carbonate, the said percentages being by total dry weight of the binder composition according to the invention.

A process for agglomerating an ore comprises mixing a binder composition containing sodium carboxymethylhydroxyethylcellulose and alkali metal carbonate, water, and concentrated ore, agglomerating the mixture into wet balls, drying the wet balls, and heating the resultant dry balls at a temperature of at least about 1204° C. wherein the binder composition comprises about 0.033% to 0.44% by weight of the total dry mixture.

DETAILED DESCRIPTION OF THE INVENTION

Sodium carboxymethylhydroxyethylcellulose (CMHEC) can be used in the composition according to the invention. A suitable material is CMHEC 420H available from Aqualon Company, Wilmington, Del.

Sodium carboxymethylhydroxyethylcellulose used in this invention generally has a carboxymethyl degree of substitution (the average number of carboxymethyl ether groups per repeating anhydroglucose chain unit of the cellulose molecule) of from about 0.1 to about 1.5, more preferably about 0.25 to about 0.75, and most preferably about 0.4. Similarly, the sodium carboxymethylhydroxyethylcellulose used in the invention generally has a hydroxyethyl molecular substitution (the average number of hydroxyethyl groups per repeating anhydroglucose unit) of from about 0.5 to about 5.0, more preferably 1.0 to 3.0 and most preferably 2.0. The preferred degree of polymerization of the cellulose used is 300 to 4000. Generally the average degree of polymerization of the derivatized cellulose is from about 300 to about 4000. Polymers having a degree of polymerization on the higher end of the range are preferred. However, best results are obtained with sodium carboxymethylhydroxyethylcellulose having a Brookfield viscosity in a 1% aqueous solution of 100–4000 cps at 20 rpm. These parameters are well known and are described in the standard text by G. I. Stelzer and E. D. Klug, "Carboxymethylcellulose", in the *Handbook of Water Soluble Gums and Resins.* Chapter 4, (R. L. Davidson, Ed.; 1980). Carboxymethylhydroxyethylcellulose is commercially available from Aqualon Company, Wilmington, Delaware.

Sodium carbonate is a powder or granular salt having the formula $Na_2CO_3$. It is commonly known as soda ash. Potassium carbonate is the other commonly available alkali metal carbonate.

Within the limits of about 10% to about 90% for the water soluble cellulose derivative, it is preferred to use about 30% to about 70%; and within the limits of about 5% to about 90% for alkali metal carbonate it is preferred to use about 30% to about 70%, all by total dry weight of the binder composition; based on a total 100%.

The binder composition may also contain (as well as the water soluble cellulose derivatives and the soda ash), substances that are formed as by products in the preparation of the cellulose derivatives, such as sodium chloride and sodium glycolate (which are often present as impurities in carboxymethylcellulose).

Small amounts of flux, e.g., limestone or dolomite, may also be added to enhance dry strength. The flux also helps to reduce the dust level in the indurating furnace when the balls are fired. Olivine, serpentine and similar minerals may be used to improve fired pellet properties.

In addition, clays such as bentonite clay optionally may be used in pelletization. The total amount of these clays will depend on the user's objectives, but will generally be less than 0.22%, based on the weight of the total dry mixture. Since silica, the major component of such clays, is detrimental to blast furnace operation, binders with substantially no clay are preferred.

Any conventional method for forming dry pellets or particles can be used to prepare the agglomerates of this invention. For instance, the concentrated ore may be agglomerated into particles or pellets by rotating the concentrated ore powder in a drum or disc with a binder and water, followed by drying and firing. Pellets can also be formed by briquetting, nodulizing, or spray drying.

Also, the addition of the binder composition constituents may be carried out conventionally. For instance, the binder constituents may be mixed as solid matter with the concentrated ore or while dissolved in water. Further, they may be simultaneously, successively or alternatively added to the concentrated ore before or during the pelletizing treatment. In a preferred method the binder composition is added to a moist concentrated ore resulting from the aforementioned separation process, which has all but about 10 wt. % of the water removed by, e.g., rotating disc filter, at a sufficient point upstream from the agglomerating drum or disc so that the binder components and concentrated ore are well mixed and adequately hydrated prior to being formed into balls.

Drying the wet balls and firing the resultant dry balls may be carried out as one continuous or two separate steps. The important factor is that the balls must be dry prior to firing as the balls will degrade or spall if fired without first drying them. Thus, in one embodiment of this invention, the wet balls are heated slowly to a temperature of at least about 1204° C. (2200° F.), preferably to at least about 1316° C. (2400° F.), and then fired at that temperature. In another embodiment, they are dried at low temperatures, preferably by heating, or, alternatively, under ambient conditions, and then fired at a temperature of at least about 1204° C., more preferably at about 1316° C. Firing is carried out for a sufficient period of time to bond the small particles into pellets, generally about 15 minutes to about 3 hours.

The process of this invention is generally employed with concentrated iron ore. This process is also suitable for non ferrous concentrated ores such as ores of zinc, lead, tin, nickel and chromium and oxidic materials such as silicates and quartz, and sulphidic materials. As a practical matter, this invention is intended for use in binding the concentrated ores that result from separation of the host rock from the ore removed from the ground. However, it can also be used to bind natural ores.

The pellets resulting from this process are dry, hard agglomerates having sizes that are suitable for shipping, handling, sintering, etc. Pellets generally have an average diameter of about 0.64 cm to 1.9cm ($\frac{1}{4}$ to about $\frac{3}{4}$ in), preferably about 0.95 cm ($\frac{3}{8}$) in. The pellet size generally depends on the preference of the user or operator, more than on any variation in the binding ability of the compositions of the invention., virtually any sizes of pellets desired by blast furnace operators and mine operators can be prepared.

Since the required amount of the binder composition according to the invention is dependent on the amounts of water and concentrated ore used in the process, the specific agglomeration method used, the nature of the ore material to be agglomerated and the desired properties of the agglomerates to be prepared, a person of ordinary skill in the art can readily determine the specific ingredient levels and amounts of the binder composition, above the minimum limits that will be most suitable for individual circumstances. Preferably the pelletization is carried out using the binder composition in an amount of from about 0.022% to about 0.66% by weight of the total dry mixture, preferably from about 0.033% to about 0.44%, and using enough water for adequate hydration, about 5% to about 15%, more preferably about 8.5% to about 10%, by weight of the total dry mixture.

This invention is illustrated in the following examples, wherein all parts, percentages, etc., are by weight unless otherwise indicated.

EXAMPLE 1

This example is directed to preparation and testing of wet and dry balls prepared using the binder of this invention.

The ore used was a magnetic taconite concentrate containing approximately 65 wt. % iron and approximately 4.6 wt. % silica obtained from a U.S. operation. In a Hobart model N 50 oscillating mixer, 3261 gr. of the ore, having a moisture content of 8.0%, was mixed with additional water (53.9 gr.) (distilled) to obtain the desired moisture level (9.5%). The chosen quantity of dry binder blend was then sprinkled onto the surface of the moist ore and mixing was continued for 3 minutes. Next, the ore/binder mix was passed one time through a high speed shredder to make a uniform, clump free blend suitable for balling. Balls were made in a 15 inch diameter (size 6.00-6) airplane tire, rotated at a rate of 65 revolutions per minute with the axis of rotation being horizontal, as follows:

1. Small amounts of ore were fed by hand into the rotating tire alternately with distilled water mist. As seed balls formed they were removed and hand screened to 4.75, +4mm. A portion (800 g) of ore was set aside for seed preparation. This process was continued until at least 100 g of seed balls were generated.
2. Ninety two (92) g of prepared seed balls were put in the rotating tire and moistened slightly with a fine mist spray of distilled water. Part of the remaining 2461 gr. of ore was added to the seeds as quickly as possible over a 1 minute period. The balls were removed and the newly formed seeds (−4.75mm) were screened out and discarded.
3. The +4.75mm balls were returned to the rotating tire and the remainder of the ore was added over a 1-1½ minute time period. The finished balls were then rolled for 5 seconds.
4. The wet balls were screened to determine size distribution. A −12.7, +11.2mm cut was used to determine moisture content. Two standard tests were used to measure performance, i.e., the drop test and the compressive strength test. The drop test and compressive strength test demonstrate the ability of wet and dry balls to withstand cracking under normal handling conditions. Balls must have sufficient prefired strength so that they do not crack during handling or transfer in the pellet plant, but must not be so plastic that they deform and impair bed permeability in the indurating furnace.

The drop test was carried out by dropping the wet balls repeatedly from a height of 56.1 cm (18 in) onto a smooth steel plate. The number cf drops required to crack a ball was recorded and the average value for 10 balls reported.

Compressive strength was measured by applying pressure to both wet and dry pellets until the pellets crumbled. The apparatus consisted of a Chatillon Model No. LTCM 3 spring testing device (manufactured by John Chatillon Company, New York, New York) with appropriate range dial push pull gauge (2.27 kg (5 lb) capacity for wet, 11.35 kg (25 lb) for dry). Dried balls were obtained by placing green balls in a ° C. oven for 18 hours. Average wet ball moisture was determined by comparing the weight of balls before and after drying. Compressive strength results presented are also the average of 10 balls tested.

The formulations used and results obtained are shown in Table 1.

TABLE 1

| Test No. | Binder | Dosage (lbs/LT) | Wet Drop Number | Wet Compressive Strength (lbs.) | Dry Compressive Strength (lbs.) | Ball Moisture (%) |
|---|---|---|---|---|---|---|
| 1-1 | 1/1 CMHEC 420 H/$Na_2CO_3$ | 1.5 | 7.7 | 2.5 | 4.4 | 9.2 |
| 1-2 | Peridur XC-3 | 1.5 | 4.6 | 2.4 | 3.3 | 9.1 |

Generally mine operators require that green balls be able to withstand at least 6 drops. Similarly, dry compressive strength of 4.54 kg (10 lb) or more is desired. In practice, however, it has been difficult to attain dry strengths of greater than 2.27 kg (5 lb) with non bentonite binders at economically acceptable use levels.

Table 1 illustrates that the binder of this invention is significantly more effective than a commercially available binder, Peridur XC-3 (Akzo NV, Arnhem, The Netherlands). Wet drop number is increased by almost 70% and dry strength by 30% compared to Peridur XC 3. Wet ball physical properties are normally increased by increasing the ball moisture content. However, the 0.1% difference seen in the example would not be expected to cause the magnitude of the difference seen.

EXAMPLE 2

This example was carried out in the same manner as described in Example 1, except for the differences mentioned below.

The ore was from a different U.S. operation than that used in Example 1. It was a magnetic taconite concentrate containing approximately 65 wt. % iron and approximately 4.5 wt. % silica.

The ore placed in the Hobart mixer had a moisture content of 9.2%. Only 3304 gr. was used and 11 gr. cf additional distilled water was added. (Note: as a result only 2504 gr. of ore remained for addition to the seeds in step 2).

The binder formulations and amounts used, and the results obtained are shown in Table 2. Again, the results show the superiority of the product of the invention compared to the commercially available product. Wet drop number and dry strength are increased by about 60% and 50%, respectively, over the commercial product.

TABLE 2

| Test | Binder | Dosage (lbs/LT) | Wet Drop Number | Wet Compressive Strength (lbs.) | Dry Compressive Strength (lbs.) | Ball Moisture (%) |
|---|---|---|---|---|---|---|
| 2-1 | 1/1 CMHEC 420 H/$Na_2CO_3$ | 1.5 | 9.5 | 2.9 | 4.0 | 9.2 |
| 2-2 | Peridur XC-3 | 1.5 | 5.8 | 2.2 | 2.6 | 9.2 |

This example was carried out by the same basic procedure as in Example 1. The ore is from the same mine as used in Example 1 albeit a different sample. Iron and silica contents are similar to that previously stated. 1% ground limestone was mixed into the damp ore prior to its being divided into test size quantities of 2832 grams. The moisture content was 8.2%. Additional distilled water in the amount of 41 gr. was added to bring the ore to 9.5% moisture. Additional information was gathered by firing the balls at about 2400° F. maximum in a 18 minute mini pot grate furnace cycle. Fifty fired balls were then crushed on a compression tester similar to that described in Example 1 and the average value reported. Also, a 1.4 lb. sample of pellets was tumbled in a steel drum for 200 revolutions and the pellets then screened to determine the amount still larger than 1/4 inch. These are strength/durability tests which indicate how well the fired balls can survive typical handling operations without breaking.

The results are presented in Table 3. This shows that the blend of the invention gives performance in the range required in all the categories evaluated. With proper moisture control the invention gives ball physical properties which in most cases exceed the competitive binder's results. This is especially evident in reference to the wet drop number and fired tumble test even at reduced dosages compared to the control.

TABLE 3

| Test No. | Binder Type Dry Blend | Dosage (lbs/LT) | Feed Moisture (%) | Wet Drop Number (lbs.) | Dry Compressive Strength (lbs.) | Ball Moisture (%) | Fired Comprehensive Strength (lbs.) | Fired Tumble (% + ¼") |
|---|---|---|---|---|---|---|---|---|
| 3-1 | 1/1 CMHEC 420 H/$Na_2CO_3$ | 1.0 | 9.5 | 6.2 | 4.7 | 9.0 | 742 | 97.3 |
| 3-2 | 1/1 CMHEC 420 H/$Na_2CO_3$ | 1.5 | 9.5 | 6.6 | 6.1 | 8.8 | 818 | 97.5 |
| 3-3 | Peridur XC-3 | 1.5 | 9.5 | 6.0 | 9.1 | 9.1 | 774 | 96.3 |
| 3-4 | 1/1 CMHEC 420 H/$Na_2CO_3$ | 1.0 | 9.5 | 7.6 | 9.4 | 9.4 | 813 | 97.0 |
| 3-5 | 1/1 CMHEC 420 H/$Na_2CO_3$ | 1.5 | 9.5 | 11.5 | 9.5 | 9.5 | 728 | 96.4 |

EXAMPLE 4

This example was carried out on a sample of ore obtained from the same location and having properties similar to that referred to in Example 2. The work was done in a pilot plant type facility, thus 400 lbs. of ore was mixed with additional water and binder as required in a muller mixer. Seeds and balls were then formed in a 4.5 foot diameter pelletizing disk. Green ball properties were determined, as in Example 1, and fired balls made and properties determined as in Example 3. The results are presented in Table 4. The results again show that binder of the invention performs adequately at the dosages tested. Most of the results obtained are better than those obtained with the commercial binder.

TABLE 4

| Test No. | Binder Type Dry Blend | Dosage (lbs/LT) | Drop Number (lbs.) | Dry Compressive Strength (lbs.) | Ball Moisture (%) | (Ave. 50) Fired Comprehensive Strength (lbs.) | Fired Tumble (% + ¼") | Fired Tumble (% - 28 mesh) |
|---|---|---|---|---|---|---|---|---|
| 4-1 | 1/1 CMHEC 420 H/$Na_2CO_3$ | 1.0 | 5.4 | 3.3 | 9.5 | 650 | 95.8 | 3.5 |
| 4-2 | 1/1 CMHEC 420 H/$Na_2CO_3$ | 1.5 | 8.2 | 4.4 | 9.8 | 594 | 96.4 | 3.1 |
| 4-3 | Peridur XC-3 | 1.5 | 4.8 | 5.1 | 9.8 | 664 | 95.7 | 3.6 |

What is claimed is:

1. An ore pellet dry mixture containing on a weight basis at least about 0.022% of a binder composition of sodium carboxymethylhydroxyethylcellulose and sodium carbonate.

2. The mixture of claim 1 combined with about 5 to 15% water by weight of the dry mixture.

3. The mixture of claim 2 containing from 0.033% to 0.44% of the binder composition and from 8.5% to 10% water by weight of the dry mixture.

4. The mixture of claim 3 where the ore is taconite.

* * * * *

UNITED STATES PATENT AND TRADEMARK OFFICE

CERTIFICATE OF CORRECTION

PATENT NO. : 4,948,430

DATED : August 14, 1990

INVENTOR(S) : BANYAI, LASOTA & STRUNK

It is certified that error appears in the above-identified patent and that said Letters Patent is hereby corrected as shown below:

Column 5, Lines 64 and 65, " $^{o}$C. "

should read -- 105$^{o}$C --

Column 6, Line 36, " cf "

should read -- of --

Column 6, Line 54, " EXAMPLE 3 " was omitted should read -- Example 3 --

Signed and Sealed this

Tenth Day of December, 1991

*Attest:*

HARRY F. MANBECK, JR.

*Attesting Officer*

*Commissioner of Patents and Trademarks*